US009347117B2

(12) United States Patent
Park et al.

(10) Patent No.: US 9,347,117 B2
(45) Date of Patent: May 24, 2016

(54) ND-BASED TWO-PHASE SEPARATION AMORPHOUS ALLOY

(75) Inventors: Eun Soo Park, Suwon-si (KR); Hye Jung Chang, Seoul (KR); Do Hyang Kim, Seoul (KR); Eun Young Jeong, Jeonju-si (KR); Jin Kyu Lee, Goyang-si (KR); Hwi Jun Kim, Yongin-si (KR); Jung Chan Bae, Gunpo-si (KR)

(73) Assignee: Yonsei University, Seoul (KR)

( * ) Notice: Subject to any disclaimer, the term of this patent is extended or adjusted under 35 U.S.C. 154(b) by 0 days.

(21) Appl. No.: 12/320,950

(22) Filed: Feb. 10, 2009

(65) Prior Publication Data

US 2009/0260720 A1 Oct. 22, 2009

Related U.S. Application Data

(63) Continuation-in-part of application No. 11/710,937, filed on Feb. 27, 2007, now abandoned.

(51) Int. Cl.

| | |
|---|---|
| ***C22C 45/00*** | (2006.01) |
| ***C22C 45/02*** | (2006.01) |
| ***C22C 1/00*** | (2006.01) |

(52) U.S. Cl.

CPC ..... *C22C 1/002* (2013.01); *C22C 45/00* (2013.01); *C22C 45/003* (2013.01); *C22C 45/02* (2013.01)

(58) Field of Classification Search

None

See application file for complete search history.

(56) References Cited

U.S. PATENT DOCUMENTS

| | | | | | |
|---|---|---|---|---|---|
| 4,668,310 | A | * | 5/1987 | Kudo et al. | 148/304 |
| 4,867,809 | A | * | 9/1989 | Haverstick | 148/101 |
| 5,074,935 | A | * | 12/1991 | Masumoto et al. | 148/403 |
| 5,258,975 | A | * | 11/1993 | Takeda et al. | 369/288 |
| 5,362,339 | A | * | 11/1994 | Horimura et al. | 148/403 |
| 5,725,684 | A | * | 3/1998 | Inoue et al. | 148/304 |

OTHER PUBLICATIONS

Takeuchi, Akira et al, Size dependence of soft to hard magnetic transition in (Nd, Pr)—Fe—Al bulk amorphous alloys, 2004, Materials Science and Engineering A 375-377, pp. 1140-1144.*

* cited by examiner

*Primary Examiner* — Colin W Slifka

(74) *Attorney, Agent, or Firm* — Rosenberg, Klein & Lee

(57) ABSTRACT

Provided is a Nd-based two-phase separation amorphous alloy by adding an element having a big difference in heat of mixing in a Nd-based alloy with a superior amorphous formability through an inherent characteristic of compositional elements and consideration of thermodynamics, at the time of forming amorphous phase, to thereby enable two-phase separation amorphous alloy during solidification. The Nd-based two-phase separation amorphous alloy is represented as a general equation $Nd_{100-a-b}(TM)_a(D)_b$ wherein TM is a combination selected from A-B, A-C and B—C when an element group of A consists of Y, Ti, Zr, La, Pr, Gd and Hf, an element group of B consists of Fe and Mn, and an element group of C consists of Co, Ni, Cu and Ag, wherein the content of the element group which constitutes the combination is 5 atomic weight % or greater, and the element selected from each of the element group is at least one element, and the content of one element selected from each of the element group does not exceed 50 atomic weight %, wherein the content of the element group of B is less than that of the element group of C when TM is a B—C combination, and wherein D is at least one selected from the group consisting of Al, B, Si and P, and a and b have the range of $20 \le a \le 70$, $5 \le b \le 30$, and $a+b \ge 40$ in terms of atomic weight %.

1 Claim, 8 Drawing Sheets

ND-BASED TWO-PHASE SEPARATION AMORPHOUS ALLOY

REFERENCE TO RELATED APPLICATIONS

This Patent Application is being filed as a Continuation-in-Part of patent application Ser. No. 11/710,937, filed 27 Feb. 2007, now abandoned.

BACKGROUND OF THE INVENTION

1. Field of the Invention

The present invention relates to a neodymium-based (Nd-based) two-phase separation amorphous alloy, and more particularly, to a Nd-based two-phase separation amorphous alloy by adding an element having a big difference in heat of mixing in a Nd-based alloy with excellent glass forming ability through an inherent characteristic of compositional elements and consideration of thermodynamics, at the time of forming amorphous phase, to thereby obtain a two-phase separation amorphous alloy during solidification.

2. Description of the Related Art

Amorphous metal can be defined as the atomic positions of the liquid phase are conceptually stopped in view of the structural analysis. Researches on the structural analysis of initial amorphous metal materials have been performed through Roentgen rays or electron diffraction based on a controversy whether the structure of the initial amorphous metal materials are amorphous or crystalline, but the research on the property of materials have not been performed. After 1970, Masumoto and Maddin have succeeded in manufacturing the uniform amorphous ribbon shape with a centrifugal quenching method. Accordingly, measurement about the property of the amorphous material has been facilitated. Since the different magnetic, electric, and mechanical properties are contained in the amorphous materials, in comparison with the conventional metal material, it has been reported that the amorphous materials are the dream metal, to thereby draw the attention of world wide metal and property researchers.

The most important one in the property of the amorphous alloy is the magnetism. The amorphous alloy has been currently developed as practical soft magnetic materials. The reasons why the amorphous alloy is suitable for the magnetic material are as follows.

1) The smaller the crystal magnetic anisotropy constant (K) and magnetism negative constant ($\lambda$) may be, the better the magnetic material, may be. It is ideally best that they become all zero. In the case of crystalline materials, Sendust (one of Fe—Al—Si alloys), and Permalloy (one of Fe—Ni alloys) are famous since the values of the crystal magnetic anisotropy constant (K) and magnetism negative constant ($\lambda$) are small. However, the composition having the values of zero in these alloys exists as only a point. However, since the amorphous composition meets $K \approx 0$, the group of the composition of $\lambda \approx 0$ has a high-permeability and low iron loss characteristic 2) Since the amorphous material is intrinsically of a big electric resistance, the low iron loss can be easily obtained.

3) Since the amorphous material can be made into thin ribbons of 20-30 μm, the low iron loss can be easily obtained.

Research and development on the amorphous materials proceed in the field of the following applications, due to the above-described magnetic property.

a. iron cores of a transformer using a high saturation magnetic flux density, and low iron loss (Fe—B—C or Fe—Si—B alloy)

b. Co-based amorphous alloy (Fe-95Co, Fe—Ni—Co, (Co, Fe)—B—Si) for making a magnetic head, and a magnetic portion for controlling a magnetic core of a switching power supply be near to zero (0)

c. Products including magnetic heads for video cassette recorders (VCR) having many advantages including a high-permeability, a less hysteresis loss, a high electric resistance to thereby cause a low overcurrent loss and an excellent high frequency property, and a high intensity to thereby cause an excellent abrasion resistance One of the currently developed Nd-based amorphous alloys is a Nd—Fe—B material which is used as a hyper-strong magnet in 1980's. It is known that a very high coercive force can be obtained in a Nd—Fe alloy which has been rapidly cooled. The Nd—Fe alloy has the advantage having the magnetic property which is more excellent than a Sm—Co magnetic material in the room temperature and a price competitive power since the raw material is inexpensive. However, the general chemical composition is near to a Fe-rich composition of $Nd_{15}Fe_{77}B_8$. Moreover, The Nd—Fe alloy has the disadvantage that the magnetic property is drastically lowered according to an increase in the temperature. Thereafter, the alloy of the Nd—Al-TM (TM=transition metal) has been reported. Nd—Al—Fe ternary alloys are under the active research on applications as the ferromagnetic materials (Materials Science and Engineering A Volumes 226-228, June 1997, Pages 393-396).

Particularly, in the case of the conventional Nd-based amorphous alloys as described above, there have been the efforts of controlling alloying elements or a cooling speed for the application of the magnetic material to thereby improve a magnetic property through nano-crystallizing of the whole or the part thereof (Journal of Magnetism and Magnetic Materials Volume 261, Issues 1-2, April 2003, Pages 122-130; Journal of Magnetism and Magnetic Materials Volumes 290-291, Part 2, April 2005, Pages 1214-1216; and Materials Science and Engineering A Volume 385, Issues 1-2, 15 Nov. 2004, Pages 38-43). Here, the nano-crystalline structure in the material suppresses movement of domain walls efficiently, to thereby increase a coercive force and magnetic susceptibility. Demagnetization has a positive effect on a magnetic property through a pinning effect that a corresponding external magnetic field is required. However, the form of precipitate is being limited to a crystal phase through crystallization of the material inside. So far, there have been no reports that the magnetic property can be improved by forming an amorphous phase of a second phase.

In the meantime, in the case of the currently developed two-phase separation amorphous alloys, there have been reports that a phase separation phenomenon is found only in the limited compositional range of Zr—La—Al—Cu—Ni, Y—Ti—Al—Co and Ni—Nb—Y based alloys through a rapid solidification process using a melt spinning process. As a result, while the two-phase separation amorphous alloy needs a higher cooling speed in comparison with a single-phase amorphous alloy. This means that the compositional range of alloy for obtaining amorphous microstructure is limited.

SUMMARY OF THE INVENTION

To solve the above problems, it is an object of the present invention to provide a Nd-based two-phase separation amorphous alloy in which elements having a big difference of heat of mixing are added in a Nd-based bulk amorphous alloy composition which has been reported to have an excellent glass forming ability through an inherent characteristic of compositional elements and consideration of thermodynamics, to thereby enable two-phase separation amorphous alloy during solidification, and the two-phase separated amorphous phase shows up a conspicuously separated crystallization behavior according to an inherent crystallization temperature difference of main elements, respectively, with a result that 1) manufacturing of the composite material is facilitated through nano-crystallization, 2) a multi-stage forming can be performed in a supercooled liquid region corresponding to the amorphous phase, respectively, and 3) a magnetic property can be improved by the amorphous phase of the second phase, or the nano-phase which can be easily formed through a thermal process.

To accomplish the above object of the present invention, there is provided a Nd-based two-phase separation amorphous alloy which is represented as a general equation $Nd_{100-a-b}(TM)_a(D)_b$, wherein the content of the element group which constitutes each combination is 5 atomic weight % or greater, and the element selected from each group is at least one, and the content of one element of each group does not exceed 50 atomic weight %, wherein the content of the element group of B is less than that of the content of the element group of C when TM is a B—C combination, and wherein D is at least one selected from the group consisting of Al, B, Si and P, and a and b have the range of $20 \leq a \leq 70$, $5 \leq b \leq 30$, and $a+b \geq 40$ in terms of atomic weight %.

In more detail, an equilibrium condition is generally determined by free energy calculation through thermodynamics consideration in the respective states of the metal materials. Particularly, mixing of two elements having a positive heat of mixing relationship forms an immiscibility gap which is an immiscible area between the two elements so that two solid solutions can be stabilized in a specific composition range.

Based on this fact, the present invention has made every effort in order to manufacture a neodymium (Nd)-based two-phase amorphous alloy. As a result, a Nd-TM group (TM is a transition element) is formed in which a base element is an element of Nd, a group of A consists of transition elements such as Y, Ti, Zr, La, Pr, Gd, and Hf having a positive heat of mixing relationship with respect to Nd, a group of B consists of transition elements such as Fe and Mn having an excellent glass forming ability together with a high crystallization temperature in a Nd-based amorphous alloy, and a group of C consists of transition elements such as Co, Ni, Cu, and Ag having a negative heat of mixing relationship with respect to Nd. Here, the two-phase separation amorphous alloy can be obtained during solidification by a positive heat of mixing relationship between Nd and the element of the A group in the TM, or between the element of B and the element of C group in the TM.

For this, the element of TM consists necessarily of any one selected from a combination of an element group among A-B, A-C and B—C, when a group of A consists of a group of elements such as Y, Ti, Zr, La, Pr, Gd and Hf having a positive heat of mixing relationship with respect to Nd, a group of B consists of transition elements such as Fe and Mn enhancing the glass forming ability and increasing the crystallization temperature in a Nd-based amorphous alloy, and a group of C consists of transition elements such as Co, Ni, Cu, and Ag having a negative heat of mixing relationship with respect to Nd, so as to match the purport of the present invention.

Furthermore, the semi-metal and non-metal elements which are known to contribute to improve the glass forming ability in the Nd-based amorphous alloy are classified as a group of D such as Al, B, Si, and P, to thereby have an excellent glass forming ability after the two-phase separation.

In the present invention, a heat of mixing relationship of an element pair which forms an immiscible area is as follows.

<Nd-A Group>

Nd—(Y or Gd): 0 KJ/mole, Nd—Ti: 17 KJ/mole, Nd—Zr: 10 KJ/mole, Nd—Hf: 13 KJ/mole, Nd—La: 0 KJ/mole, Nd—Pr: 0 KJ/mole <B—C Group>

Fe—Co: −1 KJ/mole, Fe—Ni: −2 KJ/mole, Fe—Cu: 13 KJ/mole, Fe—Ag: 28 KJ/mole

Mn—Co: −2 KJ/mole, Mn—Ni: −4 KJ/mole, Mn—Cu: 4 KJ/mole, Mn—Ag: 13 KJ/mole

In the present invention, because TM gets to deviate from a eutectic composition with Nd in the case that TM is added to Nd by less than 20% or in excess of 70% in units of atomic weight %, the glass forming ability is decreased. Particularly, in the case that the elements of each group of the A group, B group, and C group of TM are added by less than 5 atomic weight %, it is thermodynamically imperfect to form an miscibility gap which is an immiscible area between the element groups which have the positive heat of mixing relationship.

Furthermore, in the present invention, the content of one element of each group does not exceed 50 atomic weight %. If the content of one element of each group exceeds 50 atomic weight %, the glass forming ability of the alloy is decreased because the empirical formula of a multi-component system for improving the glass forming ability is not satisfied.

Furthermore, in the present invention, the content of the element group of B is less than that of the content of the element group of C when the combination of TM is B—C. In the case that TM is a combination of B—C in the present invention, two amorphous phases of Nd—B-D and Nd—C-D are formed. Because the glass forming ability of the Nd—B-D phase is greater than that of the Nd—C-D phase, relatively more content of element group of C is necessary in order to improve the glass forming ability of the Nd—C-D phase.

In order to perform the two-phase separation amorphous alloy, the glass forming ability becomes an important factor in addition to the two-phase separation of the main elements. Therefore, the elements of the D group have been selected considering the empirical formula for improving the glass forming ability (1) a multi-component system of a ternary component or greater, (2) a big difference of 12% or greater between compositional elements, (3) a composition of elements having a negative heat of mixing, and (4) the condition of the deep eutectic composition neighborhood.

Here, in the case of the D group elements are added by less than 5 atomic weight %, this violates a confusion theory which is the glass forming ability improvement concept through the multi-component system of the empirical formula. In the case that the D group elements are added in excess of 30 atomic weight %, a big change is induced in the amorphous formation combination consisting of Nd—TM-D to rather drastically reduce the glass forming ability. In addition, in the invention the condition of $a+b \geq 40$ has to be satisfied so that each amorphous phase which are separated has an improved glass forming ability by containing a sufficient level of solute elements of TM and D.

BRIEF DESCRIPTION OF THE DRAWINGS

The above and other objects and advantages of the present invention will become more apparent by describing the preferred embodiment thereof in more detail with reference to the accompanying drawings in which.

DETAILED DESCRIPTION OF THE INVENTION

Figure 1A:
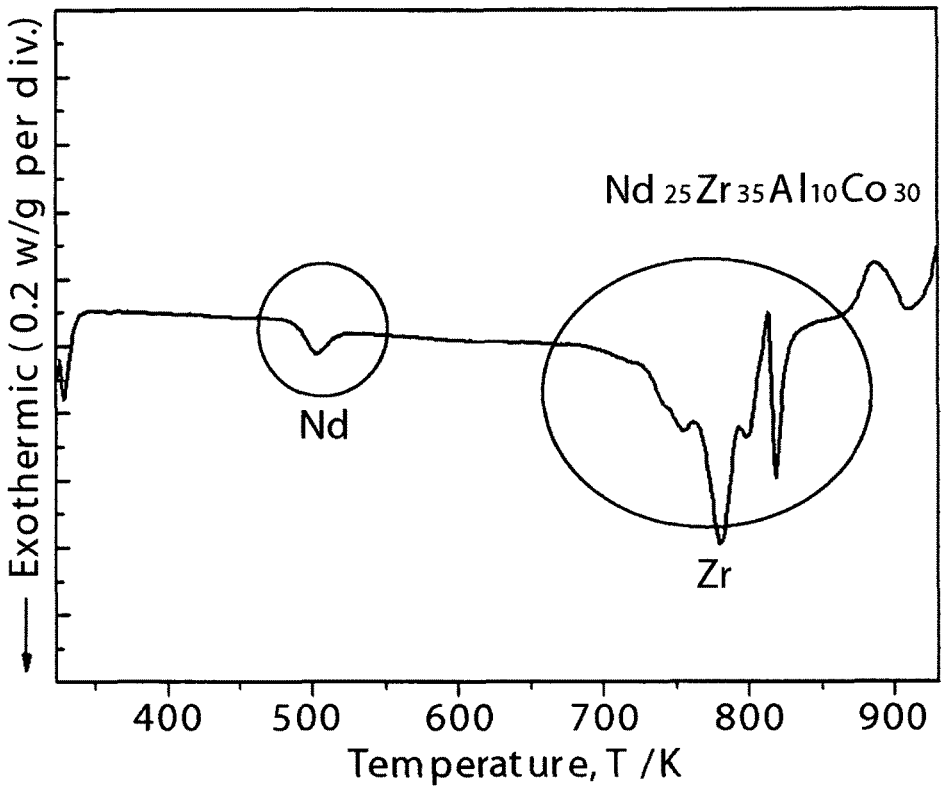
FIGS. 1A and 1B are graphical views illustrating differential thermal analysis results and X-ray diffraction analysis results with respect to a two-phase separation amorphous alloy of $Nd_{25}Zr_{35}CO_{30}Al_{10}$ according to the present invention, respectively.

A neodymium-based (Nd-based) two-phase separation amorphous alloy according to preferred embodiments of the present invention will be described below with reference to the accompanying drawings.

(Manufacturing of a Specimen)

1. Manufacturing of a Mother Alloy

In order to obtain a mother alloy of a desired alloy composition in the present invention, Nd which has a purity of 99.8%-99.99%, and elements selected from a group of A such as Y, Ti, Zr, La, Pr, Gd, and Hf, a group of B such as Fe and Mn, a group of C such as Co, Ni, Cu, and Ag, and a group of D such as Al, B, Si, and P elements have been arc-melted under a high purity argon gas atmosphere of 99.99%. Moreover, in order to remove any segregation of the alloy component during the arc-melting, a sample has been repeatedly melted three times while inverting.

2. Manufacturing of a Specimen Using a Melt Spinning Method

The prepared mother alloy has been manufactured into a specimen of a ribbon-shape by using a melt spinning method whose cooling rate is $10^4$-$10^6$ K/s.

Concretely, the mother alloy has been firstly charged into a quartz tube. Then, the mother alloy has been melted to liquid state under the argon atmosphere of 7-9 KPa with a microwave induction heating after having maintained a degree of vacuum in a chamber into about $10^{-4}$ Torr. Here, the molten metal is being maintained by a surface tension in the quartz tube. Then, the quartz tube has rapidly fallen before the reaction of the quartz tube has occurred after the mother alloy has been completely melted, and simultaneously the argon gas of about 50 KPa has been injected into the quartz tube. Accordingly, the molten metal is melt-spinned on the Cu roll surface (wheel surface velocity: about 40 m/s) which rotates at a high speed, to thereby manufacture a ribbon-shaped specimen of the thickness of about 30 μm and the width of about 2 mm.

3. Manufacturing of a Specimen Using an Injection Casting Method

In the present invention, the mother alloy has been manufactured into a bulk specimen through an injection casting method while changing a cooling speed by using a copper mold of various diameters. The high purity argon gas is charged at the high vacuum state. The mother alloy has been melted with a high frequency induction under the argon atmosphere. Then, the melted mother alloy has been charged a water-cooled copper mold through a certain fixed injection pressure, to thereby manufacture a rod-shaped specimen of a fixed length of 50 mm.

The analysis of the amorphous alloy composition according to the present invention is as follows.

(Specimen Analysis)

1. Transmission Electron Microscope Analysis

The transmission electron microscope (TEM) analysis has been conducted in order to observe the phase separation phenomenon of a bulk amorphous alloy. The specimen manufactured using an injection casting has been mechanically grinded and prepared by ion milling method. An angle between an ion beam and a specimen surface has been polished while changing into 4-8° by using the ion milling method.

Under the same condition as the above-described condition, a bright field image (BF image) and a limit viewing direction selected area diffraction pattern (SADP) has been obtained at the acceleration voltage of 200 kV using JEM 2000EX.

2. Differential Thermal Analysis

In general, in order to estimate thermodynamic properties which relate to a glass transition temperature (Tg) of an amorphous phase, and a crystallization temperature (Tc), a differential scanning calorimetry (Perkin Elmer, DSC7) has been used.

In this experiment, a sample has been put into a copper fan, and then put in a platinum holder. Then, an empty pan has been put into a reference. The thermodynamic properties have been measured under the high purity argon atmosphere of 99.999% at the temperature range of 373-953K in order to prevent the oxidation of the specimen. The DSC analysis has been performed under the 99.99% purity argon atmosphere after having charged a sample of about 20 mg at a constant temperature-up rate of 40 K/min (0.667 K/s).

3. X-ray Diffraction Analysis

In order to identify whether the manufactured specimen has an amorphous phase, an X-ray diffractometry ($M18XHF^{22}$—SRA, monochromatic Cu K radiation) has been used to irradiate X-rays onto the specimen. The X-ray diffraction analysis has been performed with the condition of a tube voltage of 50 kV and current of 200 mA of a Cu target ($\lambda$=1.5406, $Ka_1$ ray). X-ray diffraction spectrum has been obtained within the range of a scanning range of 20°-80° with a sequential scanning method, at the speed of 4°/min while maintaining 0.02° interval.

In general, in the case of an amorphous specimen, a broad diffraction pattern with no crystalline picks has been obtained in the X-ray diffraction analysis. Differently from the general amorphous alloy, the diffraction patterns regarding the two amorphous phases have been overlapped in the two-phase amorphous alloy. As a result, it can be confirmed that the present invention has a relatively wider diffraction angle region.

4. TMA Analysis

In a supercooled liquid region, TMA (TMA-7, Perkin-Elmer) has been used in order to measure viscosity of the amorphous alloy. By using a specimen of a rod-shape and a ribbon-shape, a certain compressive load is applied by a ceramic probe whose diameter is 3 mm at a compressed mode, and then a change in length of a specimen has been measured while increasing the temperature. Correction for temperature has been performed using In and Zn specimens before all the experiments. The experiment has been progressed under the Ar atmosphere.

5. VSM (Vibrating Sample Magnetometer) Analysis

A macroscopic magnetism change has been measured according to temperature in the form of a ribbon or powder with respect to the two-phase amorphous alloy according to the invention using a VSM (Vibrating Sample Magnetometer). A change in a magnetic property (or magnetization) according to temperature has been measured with a magnetic force of 2 tesla at maximum and at the range of the temperature of 10K to 300K.

TABLE 1

| Items | | Composition (at %) | $T_g1$ | $T_x1$ | $T_g2$ | $T_x2$ | Manufacturing/form |
|---|---|---|---|---|---|---|---|
| Examples | 1 | $Nd_{25}Zr_{35}Co_{30}Al_{10}$ | 468 | 488 | 671 | 719 | M/DA |
| | 2 | $Nd_{30}Zr_{25}Hf_5Co_{30}Al_{10}$ | 477 | 501 | 667 | 712 | M/DA |
| | 3 | $Nd_{50}Ti_{10}Co_{30}Al_{10}$ | 496 | 519 | 562 | 587 | M/DA |
| | 4 | $Nd_{15}Y_{40}Co_{25}Al_{20}$ | 598 | 646 | 810 | 848 | M/DA |
| | 5 | $Nd_{30}La_{30}Co_{30}Al_{10}$ | 462 | 498 | 554 | 586 | M/DA |
| | 6 | $Nd_{30}Ti_{30}Fe_{30}Al_{10}$ | 470 | 498 | 705 | 727 | M/DA |
| | 7 | $Nd_{30}Gd_{30}Fe_{30}Al_{10}$ | 472 | 508 | 823 | 857 | M/DA |
| | 8 | $Nd_{50}Mn_{20}Co_{15}Al_{15}$ | 534 | 562 | 682 | 715 | M/DA |
| | 9 | $Nd_{50}Fe_{10}Co_{25}Al_{15}$ | 528 | 570 | 752 | 782 | I/DA |
| | 10 | $Nd_{50}Fe_5Co_{30}Al_{12}B_3$ | 527 | 560 | 769 | 789 | I/DA |
| | 11 | $Nd_{57}Fe_{10}Co_{15}Al_{15}Si_3$ | 478 | 507 | 688 | 727 | M/DA |
| | 12 | $Nd_{55}Fe_{12}Ni_{18}Al_{15}$ | 480 | 510 | 732 | 760 | I/DA |
| | 13 | $Nd_{50}Fe_5Ni_{30}Al_{12}P_3$ | 530 | 561 | 752 | 766 | M/DA |
| | 14 | $Nd_{50}Fe_{20}Ag_{15}Al_{15}$ | 492 | 522 | 716 | 784 | I/DA |
| | 15 | $Nd_{50}Fe_{10}Ag_{20}Cu_5Al_{15}$ | 499 | 524 | 735 | 758 | M/DA |
| Comparative Examples | 1 | $Nd_{60}Fe_{30}Al_{10}$ | — | — | 712 | 797 | M/SA |
| | 2 | $Nd_{70}Fe_{10}Co_5Al_{15}$ | — | — | — | 734 | M/Comp. |
| | 3 | $Nd_{10}Fe_{75}Co_7B_8$ | — | — | — | 870 | M/Comp. |
| | 4 | $Nd_{56}Zr_4Co_{30}Al_{10}$ | 496 | 521 | — | — | M/SA |
| | 5 | $Nd_{30}V_{30}Fe_{30}Al_{10}$ | — | — | 732 | 776 | M/Comp. |
| | 6 | $Nd_{30}Nb_{30}Co_{30}Al_{10}$ | — | — | — | — | M/Cryst. |
| | 7 | $Nd_{60}Fe_{15}Mn_{15}Al_{10}$ | — | — | — | — | M/Cryst. |
| | 8 | $Nd_{50}Ni_{20}Cu_{15}Al_{15}$ | 503 | 542 | — | — | M/SA |
| | 9 | $Nd_{50}Fe_{20}Zn_{15}Al_{15}$ | — | — | — | — | M/Cryst. |
| | 10 | $Nd_{65}Mn_{17}Co_{15}Si_3$ | — | — | — | — | M/Cryst. |
| | 11 | $Nd_{40}Mn_{15}Cu_{10}Al_{35}$ | — | — | — | — | M/Cryst. |
| | 12 | $Nd_{25}Zr_{35}Co_{30}C_{10}$ | — | — | — | — | M/Cryst. |

(Unit: Kelvin Temp.)

Here, M=Melt spinning method, I=Injection casting method, SA=single phase amorphous state, DA=two-phase amorphous state, Cryst.=crystallization, and Comp. =SA+Cryst.

As can be seen from Table 1, the alloys according to the present invention have two-phase separation amorphous microstructure (DA) during solidification. The glass forming ability of the two-phase separation amorphous alloy depends on cooling rates greater than that of the single amorphous alloy. However, in the case of the Nd—Fe—Co—Al group, the Nd—Fe—Ni—Al group, and the Nd—Fe—Ag—Al group amorphous alloy according to the present invention, the two-phase amorphous can be obtained through an injection casting method having a relatively small cooling rate of about 10-100K/S.

In Comparative Example 1, only the element of the B group among the TM is selected. This violates the present invention requirement that at least two groups should be selected among the TM. The immiscible area is not formed due to the absence of the elements which has a positive heat of mixing. Thus, the Comparative Example 1 shows an example in which the amorphous alloy of the simple Nd-based single phase is formed.

In Comparative Example 2, the elements of TM are added by less than 20 wt %. In this case, the TM gets to deviate from a eutectic composition with Nd. Then, the glass forming ability of this alloy is reduced. As a result, a complete amorphous phase is not obtained even through a rapid solidification process.

In Comparative Example 3, the elements of TM are added in excess of 80 wt %. The TM element (Fe) becomes a main component in this composition. Accordingly, the TM gets to deviate from a eutectic composition in a combination of Nd—TM-(D group), to thereby greatly reduce the glass forming ability. As a result, a complete amorphous phase is not obtained even through a rapid solidification process.

In Comparative Example 4, the element of the A group among the TM is added by less than 5 wt % which is presented on the basis of a minimum standard. In this case, an element of the A group, Zr is insufficient in quantity to form an immiscible area together with the main element Nd. Thus, the Comparative Example 4 shows an example in which the amorphous alloy of the Nd-based single phase is formed.

In Comparative Examples 5 and 6, the other elements of V and Nb are added instead of the A group element according to the present invention. In these cases, although they have the positive heat of mixing value of 18 KJ/mole and 32 KJ/mole with respect to Nd, respectively, they have a relatively high melting temperature when the elements of V and Nb are combined with the other compositional elements. Accordingly, the Comparative Examples 5 and 6 violate the empirical formula for amorphous phase formation that they have to have the deep eutectic composition. Thus, the Comparative Examples 5 and 6 represent that formation of amorphous phase is not facilitated even through a rapid solidification process, respectively.

In Comparative Example 7, only the element of the B group among the TM is selected. This violates the present invention requirement that at least two groups should be selected among the TM. Thus, the Comparative Example 7 shows an example in which two-phase separation of amorphous are not facilitated even through a rapid solidification process.

In Comparative Example 8, only the element of the C group among the TM is selected. This violates the present invention requirement that at least two groups should be selected among the TM. Thus, Comparative Example 8 shows an example that the Nd-based single phase of amorphous is made since it has a difficulty in forming an immiscible area.

In Comparative Example 9, zinc (Zn) which is an element other than those of the present invention is added as an element of TM. The Comparative Example 9 shows an example that amorphous is not achieved even through a rapid solidification since the glass forming ability is very low.

In Comparative Examples 10 and 11, the element of the D group is added by less than 5 wt % or in excess of 30 wt %. These show that the element of the D group which has been added by less than 5 wt % or in excess of 30 wt % plays a negative role in a correlation between the existing elements and thus amorphous is not achieved even through a rapid solidification since the glass forming ability is abruptly reduced.

In Comparative Example 12, a semi-metal or non-metal element different from the D group elements is added. Accordingly, when carbon (C) is added, the Comparative Example 12 violates the empirical formula for enhancing glass forming ability glass forming ability in the Nd-based alloy. Thus, the Comparative Example 12 shows an example that amorphous is not obtained even through a rapid solidification process.

Hereinbelow, a Nd-based two-phase separation amorphous alloy according to the present invention will be described in more detail with reference to the accompanying drawings.

Figure 1B:
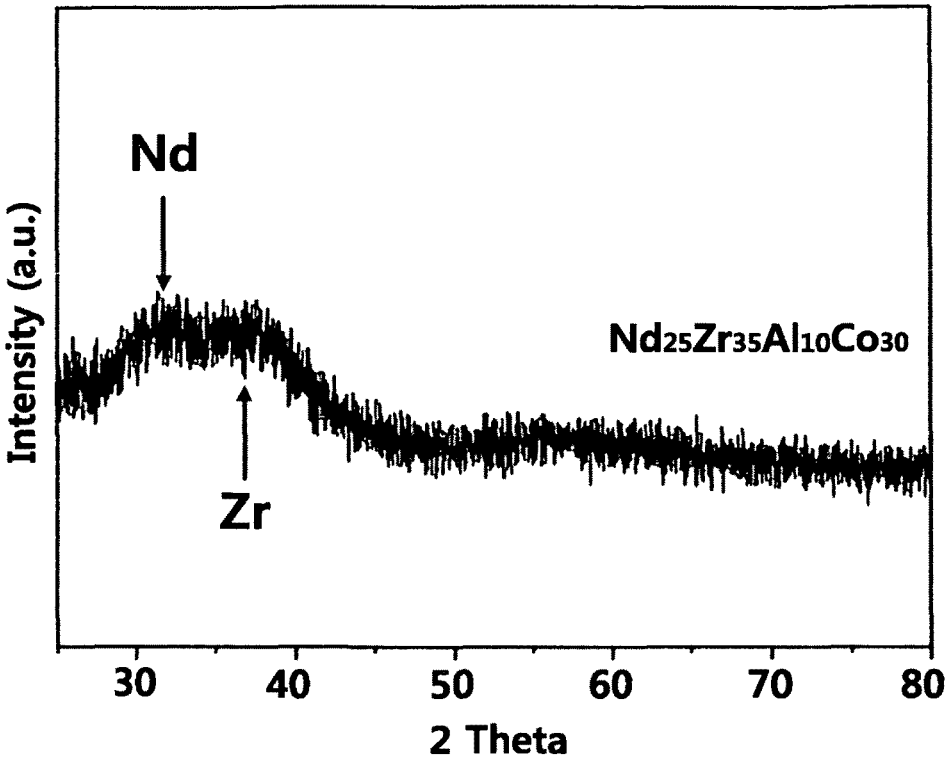

FIGS. 1A and 1B are graphical views illustrating differential thermal analysis results and X-ray diffraction analysis results with respect to a two-phase separation amorphous alloy of $Nd_{25}Zr_{35}CO_{30}Al_{10}$ according to the present invention, respectively. As can be seen from FIG. 1A, the two-phase separation amorphous alloy of the present invention shows a crystallization behavior conspicuously separated by the difference in the crystallization temperature range of main elements with a positive heat of mixing relationship. Moreover, as can be seen from FIG. 1B, the two-phase separation amorphous alloy of the present invention shows a typical amorphous halo pattern in an inherent two-theta (2θ) section which has been determined by the inherent atom radius of main elements whose two phases have been separated by a positive heat of mixing relationship from an X-ray diffraction analysis result. As a result, a diffraction pattern which two halo patterns have been overlapped can be obtained.

Figure 2:
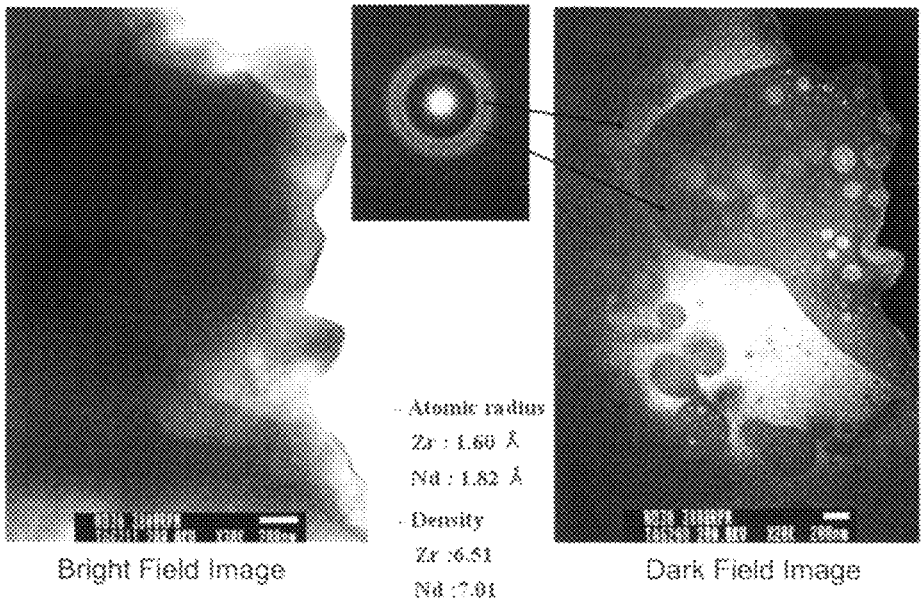
FIG. 2 is a photographical view illustrating transmission electron microscope analysis results with respect to a two-phase separation amorphous alloy of $Nd_{25}Zr_{35}CO_{30}Al_{10}$ according to the present invention.

FIG. 2 is a photographical view illustrating transmission electron microscope analysis results with respect to a two-phase separation amorphous alloy of $Nd_{25}Zr_{35}CO_{30}Al_{10}$ according to the present invention. As can be seen from FIG. 2, in the case of a two-phase separation amorphous alloy of $Nd_{25}Zr_{35}CO_{30}Al_{10}$ according to the present invention, two halo rings which are separated by the atom radius difference of a respectively separated amorphous main element are obtained similarly to the X-ray diffraction analysis results. The shape of amorphous phases obtained in this two-phase separation alloy of $Nd_{25}Zr_{35}CO_{30}Al_{10}$ is indistinguishable through a Bright Field Image due to a similar density value of the separated amorphous phase, but definitively distinguishable through a Dark Field Image.

Figure 3:
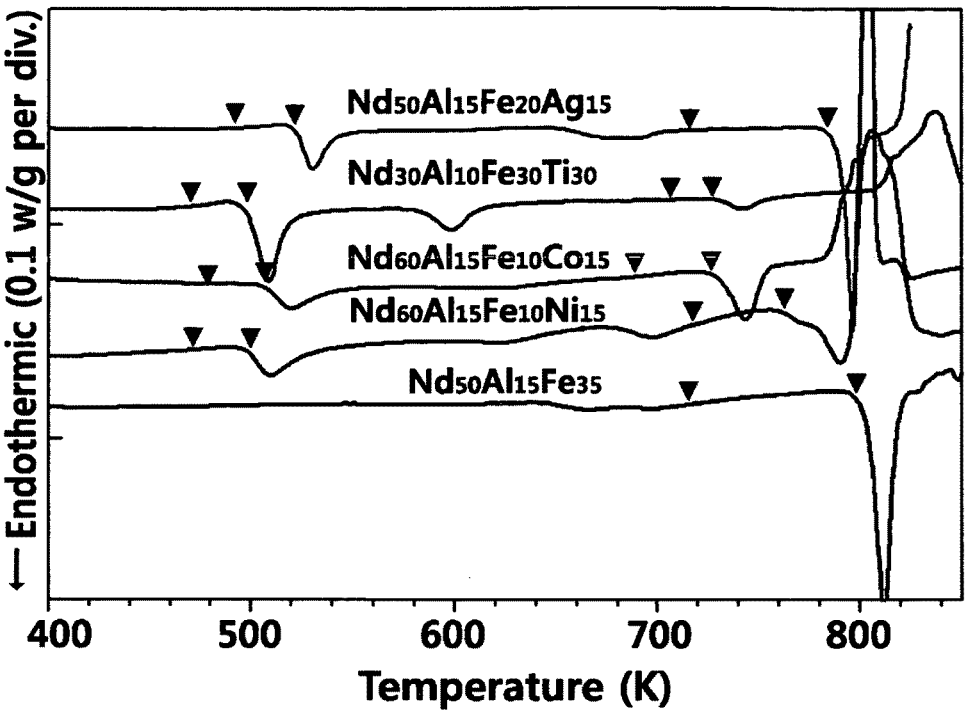
FIG. 3 is a graphical view illustrating differential thermal analysis results with respect to alloys of Nd—Fe—X—Al according to the present invention.

FIG. 3 is a graphical view illustrating differential thermal analysis results with respect to alloys of Nd—Fe—X—Al according to the present invention. As can be seen from FIG. 3, it can be confirmed that a crystallization behavior for each separated ally occurs in two divided temperature ranges by a positive heat of mixing relationship. In this way, the alloy composition having the separated crystallization behavior has a supercooled liquid region of a certain temperature area showing a super plasticity behavior before the crystallization behavior, respectively.

Figure 4:
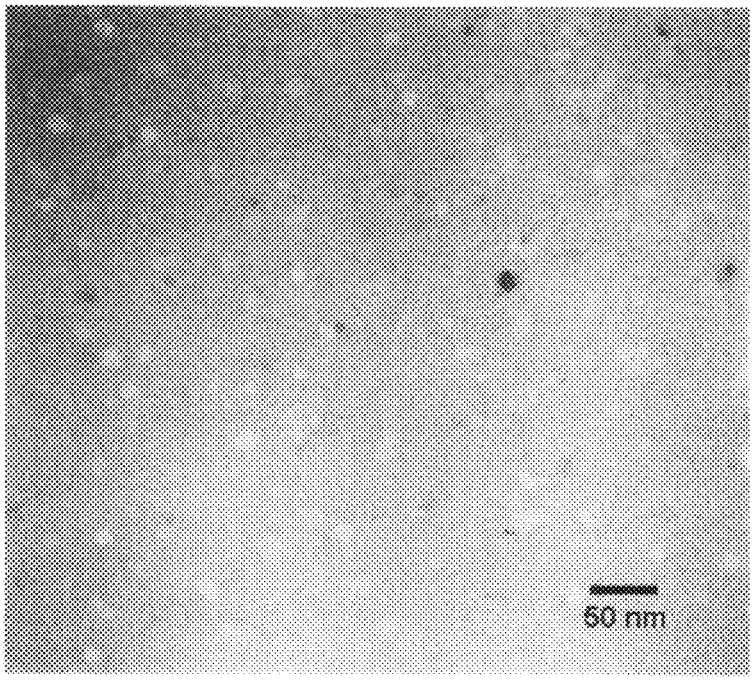
FIG. 4 is a photographical view illustrating transmission electron microscope analysis results with respect to a two-phase separation amorphous alloy of $Nd_{30}Ti_{30}CO_{30}Al_{10}$ after having undergone selective nano-crystallization through a thermal process according to the present invention.

FIG. 4 is a photographical view illustrating transmission electron microscope analysis results of a sample which has undergone a thermal process up to 600K, with respect to a two-phase separation amorphous alloy of $Nd_{30}Ti_{30}CO_{30}Al_{10}$ according to the present invention. As can be seen from FIG. 4, in the case that the two-phase separation alloy of $Nd_{30}Ti_{30}CO_{30}Al_{10}$ according to the present invention is thermally treated up to 600K, it can be confirmed that nanocrystalline phase having particle size of several tens of nanometers have partially appeared by a first crystallization behavior relating to a Nd-based amorphous phase, and an amorphous phase is maintained for the other regions. That is, it can be confirmed that the crystallized region and the amorphous region have a composite form of a nano-scale. As a result, it is possible to perform a selective crystallization due to the separated crystallization behavior of the two-phase separation amorphous alloy, to thereby manufacture nanocomposite materials.

Figure 5:
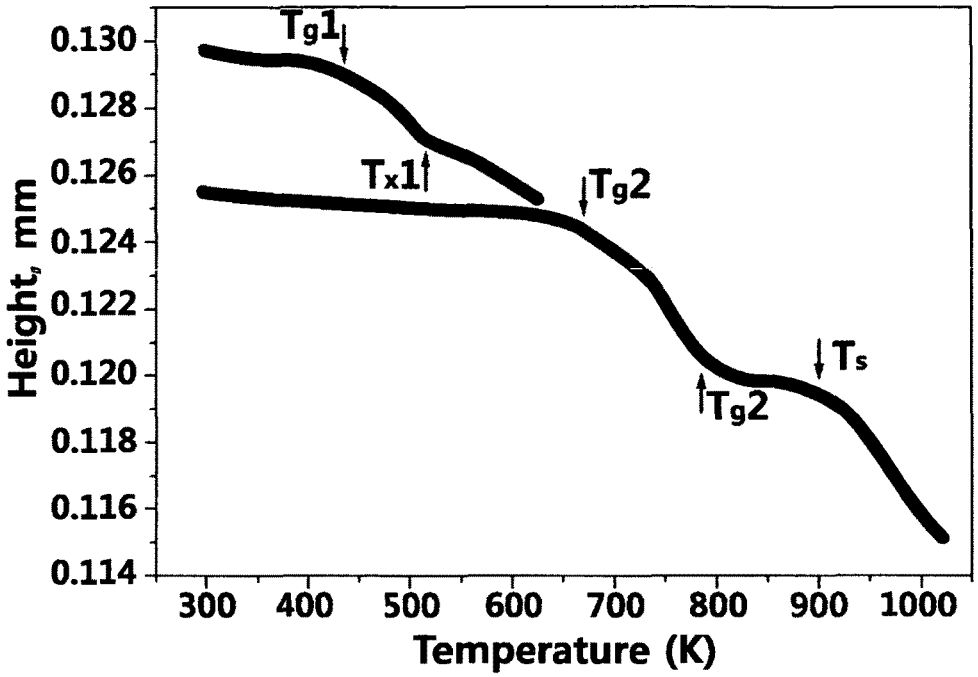
FIG. 5 is a graphical view illustrating height variation measurement results of a specimen according to temperature using a thermo-mechanical analyzer (TMA) with respect to an alloy of $Nd_{30}Ti_{30}CO_{30}Al_{10}$ according to the present invention.

FIG. 5 is a graphical view illustrating height variation measurement results of a specimen according to temperature using a thermo-mechanical analyzer (TMA) with respect to an alloy of $Nd_{30}Ti_{30}CO_{30}Al_{10}$ according to the present invention. In the case of the alloy of $Nd_{30}Ti_{30}CO_{30}Al_{10}$ according to the present invention, it can be confirmed that a sudden height variation is undergone in a first supercooled liquid region (450-500K) which relates to the Nd-based amorphous phase. This is the same result as that of the previously known super plastic deformation of the amorphous alloy. However, in the case of the two-phase separation amorphous alloy composition of the present invention, it can be confirmed that a step portion (a sudden height decreasing area according to the temperature increment) which has implied that a second variation is possible in a supercooled liquid region (680-740K) relating to a second crystallization behavior relating to Zr differently from a single amorphous phase. In the vicinity of about 900K (that is, at the solidus melting temperature (Ts), a sudden height reduction is initiated in connection with the melting of the Nd-based amorphous alloy.

Figure 6A:
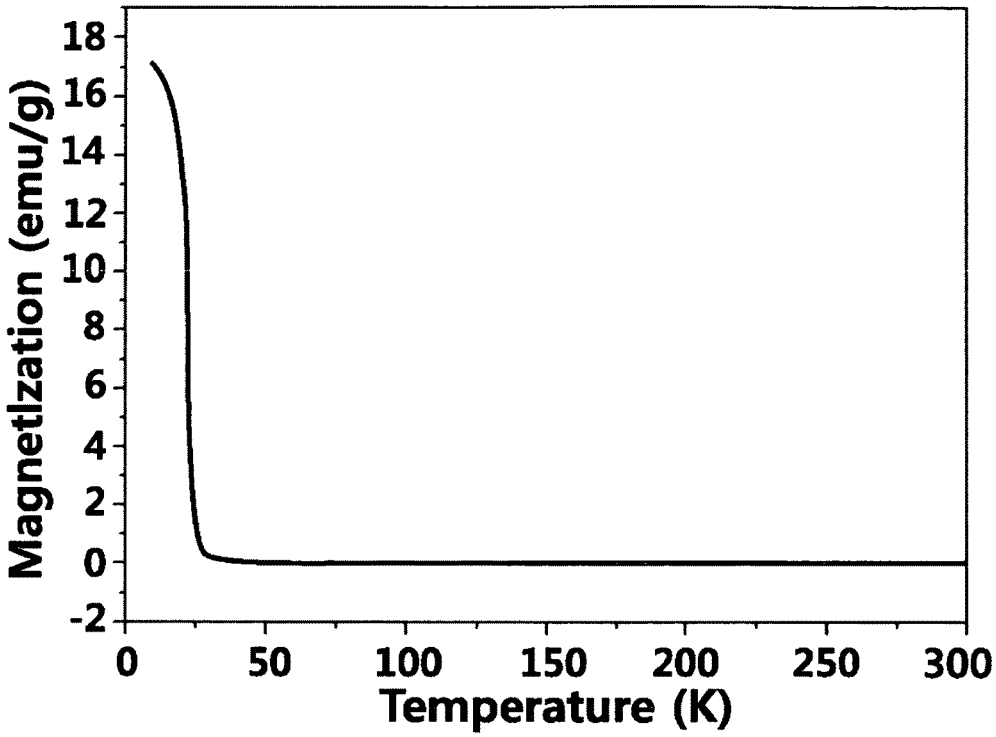
FIG. 6 is a graphical view illustrating results which is obtained by measuring a magnetic field versus magnetization behavior according to temperature using a vibrating sample magnetometer (VSM) with respect to an alloy of $Nd_{30}Ti_{30}CO_{30}Al_{10}$ according to the present invention.
Figure 6B:
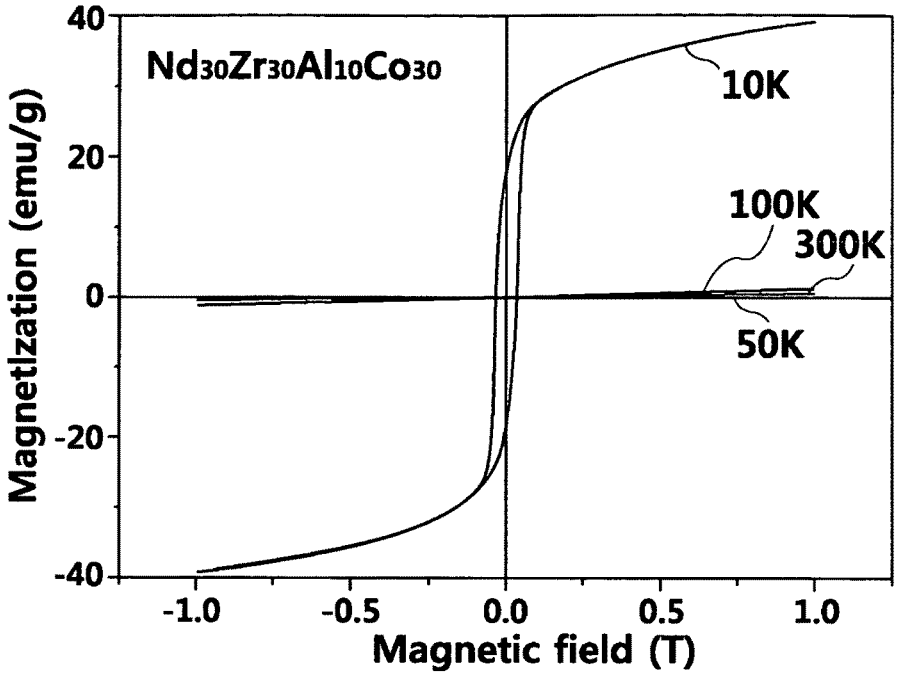

FIG. 6 is a graphical view illustrating results which is obtained by measuring a magnetic field versus magnetization behavior according to temperature using a vibrating sample magnetometer (VSM) with respect to an alloy of $Nd_{30}Ti_{30}CO_{30}Al_{10}$ according to the present invention. In the case of the two-phase separation alloy of $Nd_{30}Ti_{30}CO_{30}Al_{10}$ according to the present invention, as shown in FIG. 6, a spin reorientation temperature in which orientation of spins begins to be changed is about 30K. That is, in the room temperature, the spins are oriented to an out-of-plane direction. If the temperature gets to fall down to 30K or less, the spins rotate while forming a cone. As a result, an in-plane component of the spins is generated so that a magnetization value increases in an in-plane direction. This phenomenon is one of the general properties which show up in the magnetic materials. However, in the case of the two-phase separation alloy of the present invention, it can be confirmed that the magnetic property drastically changes from the soft magnetic characteristic to the hard magnetic characteristic, at the spin reorientation temperature due to the presence of a second amorphous phase. This phenomenon is taken into consideration that the two-phase separation alloy of $Nd_{30}Ti_{30}CO_{30}Al_{10}$ according to the present invention can be used as a data storage medium etc., since spins are firstly oriented in an in-plane direction at the low temperature, a preference magnetization direction is changed according to a temperature, and a magnetism switching is possible at the time of applications with a little temperature change.

As described above, a Nd-based alloy which enables two-phase amorphous alloy according to the present invention has the following effects.

1) An amorphous alloy composition can be manufactured in an in-situ manner through a thermodynamic access, in which a two-phase amorphous material having an excellent glass forming ability is phase-separated from the amorphous alloy composition and then phase-separated amorphous material exists.

2) A phase separation mechanism applied in the amorphous alloy composition according to the present invention, presents standards designing an amorphous material in a new concept differing from previously proposed empirical formulas as well as opposing the general empirical formulas regarding the amorphous formation. Furthermore, two-phase bulk amorphous alloy compositions by the phase separation can be easily developed in the other alloy systems in the future.

3) The two-phase separation amorphous alloy according to the present invention exhibits a phase separation having a quite fine connection structure of a nano-scale. Thus, a two-phase separated composition can be selectively nano-crystallized through a selective thermal process or a control of a cooling rate, to thereby easily manufacture an amorphous based nano-composite material.

4) The two-phase separation amorphous alloy according to the present invention shows two supercooled liquid regions in respect of both of the two amorphous phases. Accordingly, a multi-stage deformational behavior is available in the supercooled liquid region. In more detail, a supercooled liquid region using the super-plasticity of the amorphous material for the existing micro electro mechanical systems (MEMS), including, the processing of the material through microforming etc., is mainly used, but the two amorphous phases of the invention have the supercooled liquid region separately with respect to the respective amorphous phase in the case of the alloy according to the present invention. It is possible to obtain an amorphous based composite material through a nano-crystallization process by appearance of the second supercooled liquid region, to accordingly be applicable as a new processing method for a nano-composite material.

5) In the case of the Nd-based two-phase amorphous alloy according to the present invention, a magnetic property is improved by a nano-phase which can be easily formed through the second amorphous phase or a thermal process of the two-phase amorphous alloy. In this way, a neodymium-based amorphous alloy which enables a nano-structure control has a big potential in view of high value-added industry applications including electric and electronic industries etc., differently from the existing concept for enhancing the magnetic property through nano-crystallization relying upon various kinds of thermal treatments and processes.

As described above, the present invention has been described with respect to particularly preferred embodiments. However, the present invention is not limited to the above embodiments, and it is possible for one who has an ordinary skill in the art to make various modifications and variations, without departing off the spirit of the present invention.

What is claimed is:

1. A Nd-based two-phase separation amorphous alloy for magnetic material applications which is represented as a general equation $Nd_{100-a-b-c}(TM1)_a(TM2)_bD_c$ consisting of:

TM1 being Fe, and TM2 being Ag or Ag and Cu, wherein the content of each of said TM1 and TM2 does not exceed 50 atomic weight %, wherein D is Al, a and b have the range of $60 \leq a+b \leq 70$ and $5 \leq c \leq 20$ in terms of atomic weight %, wherein said TM1 and TM2 exhibit positive enthalpy of mixing causing a miscibility gap between first constituting elements of Nd-TM1-D and second constituting elements of Nd-TM2-D, and wherein the alloy has a two-phase separation amorphous microstructure (DA) with a first and a second phase nano-scale microstructures formed during solidification in correspondence with said miscibility gap between said first and second constituting elements, and exhibits two super-cooled liquid regions with respect to said first and second amorphous phases to enable a multi-stage deformation behavior.

* * * * *